US006779373B2

(12) United States Patent
Barten et al.

(10) Patent No.: US 6,779,373 B2
(45) Date of Patent: Aug. 24, 2004

(54) METHOD FOR PREADJUSTING AND CONTROLLING THE STRIP PLANARITY IN FLEXIBLE SINGLE-PASS AND REVERSING ROLLING OF A STRIP-SHAPED MATERIAL WEB

(75) Inventors: Axel Barten, Siegen (DE); Werner Stahl, Kreuztal (DE)

(73) Assignee: Achenbach Buschhütten GmbH, Kreuztal (DE)

( * ) Notice: Subject to any disclaimer, the term of this patent is extended or adjusted under 35 U.S.C. 154(b) by 0 days.

(21) Appl. No.: 10/260,223

(22) Filed: Sep. 27, 2002

(65) Prior Publication Data

US 2003/0074941 A1 Apr. 24, 2003

(30) Foreign Application Priority Data

Sep. 29, 2001 (EP) ..... 01123512

(51) Int. Cl.[7] ..... B21B 37/68

(52) U.S. Cl. ..... 72/7.6; 72/9.1; 72/11.7; 700/154

(58) Field of Search ..... 700/28, 29, 30, 700/31, 148, 154; 72/7.1, 7.6, 8.3, 8.9, 9.1, 11.1, 11.6, 11.7

(56) References Cited

U.S. PATENT DOCUMENTS

| | | | | |
|---|---|---|---|---|
| 4,776,192 A | * | 10/1988 | Oda et al. | 72/10.1 |
| 6,158,260 A | * | 12/2000 | Ginzburg | 72/9.1 |
| 6,230,532 B1 | * | 5/2001 | Kaji et al. | 72/9.1 |

FOREIGN PATENT DOCUMENTS

| | | | | |
|---|---|---|---|---|
| DE | 4331261 | | 4/1994 | |
| DE | 197 13 004 A1 | | 6/1999 | |
| DE | 100 36 564 A1 | | 2/2001 | |
| DE | 100 37 867 A1 | | 6/2001 | |
| EP | 0738548 | | 10/1996 | |
| EP | 1044737 | | 10/2000 | |
| JP | 8-90021 | * | 4/1996 | B21B/37/00 |

OTHER PUBLICATIONS

Hachmann et al: "Walzen Belastungsoptimierter Laengsprofile", Stahlcolloquium, Aachen, DE, Mar. 27, 1992, pp. 4.2–1–4.2–6.

Hauger A: "Kostengünstiges Verfahren, Durch Flexibles Walzen . . . ", Fertigung, Landsberg, DE, BD. 23, No. 10, Oct. 1995 pp. 40–42.

Patent Abstracts of Japan, vol. 011, No. 247 (M–615), Aug. 12, 1987 & JP 62 057704 A (Nippon Steel Corp), Mar. 13, 1987.

Patent Abstracts of Japan, vol. 1995, No. 08, Sep. 29, 1995 & JP 07 116719 A (Kawasaki Steel Corp), May 9, 1995.

* cited by examiner

*Primary Examiner*—Ed Tolan
(74) *Attorney, Agent, or Firm*—Friedrich Kueffner

(57) ABSTRACT

A method for preadjusting and controlling strip planarity in flexible single-pass and reversing rolling of a strip-shaped material web using at least one work roll pair forming a roll gap and back-up rolls for the work rolls, and devices for roll adjustment, roll bending, roll displacement and roll balancing. The method includes, when rolling a thickness ramp for adjusting a desired strip profile shape over the strip width, determining corresponding adjustment parameters by accessing on-line a multidimensional data matrix produced off-line through a FEM model for all adjustment ranges of rolling force, roll displacement and bending control at all occurring strip widths.

9 Claims, No Drawings

METHOD FOR PREADJUSTING AND CONTROLLING THE STRIP PLANARITY IN FLEXIBLE SINGLE-PASS AND REVERSING ROLLING OF A STRIP-SHAPED MATERIAL WEB

BACKGROUND OF THE INVENTION

1. Field of the Invention

The present invention relates to a method for preadjusting and controlling the strip planarity in flexible single-pass and reversing rolling of a strip-shaped material web by means of at least one pair of work rolls which form a roll gap and associated back-up rolls as well as devices for roll adjustment, roll bending, roll displacement and roll balancing.

2. Description of the Related Art

The continuous improvement of environmental conditions, the scarcity of raw materials, and the requirement that the industry inexpensively manufacture structural components of different types with optimum properties which are specific with respect to the product, require the development of new manufacturing methods. Among these is the so called "flexible rolling" whose object it is to manufacture rolled products with cross-sectional shapes which are optimized with respect to load application and weight. Flexible rolling, in which the roll gap is regulated during the rolling process in accordance with the thickness profile of a rolled strip which changes over the strip length, facilitates the manufacture of strip material having a thickness profile which is precomputed and component-specific and adapted to the respective load application, wherein the thickness profile changes in the rolling direction, and wherein this manufacture reduces the length of the processes. A rolled strip manufactured of steel and non-iron metals is suitable for light-weight construction in the fields of automobile construction, aircraft and spacecraft technology and rail car construction (DE-Z Fertigung, 1995, Volume 23, Issue 10, pages 40–42).

In conventional rolling, it is desirable to produce a strip which is as flat as possible without any changes of the profile over the entire strip length. In flexible rolling, on the other hand, controlled strip thickness changes over the strip length are to be manufactured while maintaining the strip planarity over the strip width. Methods for producing flat strips with constant strip thicknesses are known in the prior art. However, for maintaining the strip planarity over the strip width, additional special preadjustment measures are required in the entire area of the strip thickness changing ramp. The possible strip thickness reduction can take place in a range between a small reduction which still maintains a stable rolling process and a maximum reduction of more than 50%.

DE 100 36 564 C2 describes a multi-roll stand for the flexible rolling of strip material with a control of the work roll bending devices in dependence on the rolling force and the strip width. With increasing pass reduction and the resulting increase of the rolling force over the thickness profile ramp produced by flexible rolling in the rolling direction, the positive bending force at the work rolls is increased in order to compensate for the portion of the increasing roll bending. This is part of the control of the strip planarity over the strip width. Conversely, when the pass reduction is decreased, the positive work roll bending is again reduced. For increasing the effectiveness of the work roll bending, the back-up rolls are displaceable independently of each other in the axial direction by equal or different distances relative to the vertical middle plane of the roll stand for compensating the occurring roll bending and for adjustment to the strip width.

In a method for flexible rolling of a metal strip disclosed in DE 100 37 867 A1, during each adjustment of the roll cap or immediately thereafter, the elastic lines of the work rolls are controlled in dependence on the adjusted roll gap for achieving a planarity of the metal strip.

DE 197 13 004 A1 is directed to a method for preadjusting and controlling the planarity of a continuously rolled strip of uniform thickness in which the roll gap profile is determined by nominal values for the roll gap profile with the aid of a roll gap model and, without knowing the precise functional relationships between the variables strip thickness, strip width, work roll diameter and rolling force, the precomputed roll gap profile or an equivalent variable is adjusted or adapted with a correction value.

DE 43 31 261 C2 describes possibilities for an asymmetrical work roll bending control for conventional rolling of strip-shaped rolled material of uniform thickness for achieving a flat material web by using pairs of bending forces having the same total magnitude, wherein the bending forces of each pair have the same or different magnitudes and act in the same or opposite directions.

SUMMARY OF THE INVENTION

It is the primary object of the present invention to develop a method for the preadjustment and control of the strip planarity in flexible rolling of a strip-shaped material web with thickness-profiled ramps in each strip length section in the rolling direction over the strip width.

Starting from the method for preadjustment and control of strip planarity in flexible single-pass and reversing rolling of a strip-shaped material web, the object is met in accordance with the present invention when rolling a thickness ramp for adjusting a desired strip profile shape over the strip width, by determining the corresponding adjustment parameters by accessing on line a multidimensional data matrix produced off line by means of a FEM model for all adjustment ranges of the rolling force, the roll displacement and the bending control at all occurring strip widths.

DETAILED DESCRIPTION OF THE INVENTION

For reducing the quantity of data of the multidimensional data matrix, the strip profile shapes determined off-line by a FEM model can also be determined for graduated adjustment ranges of the rolling force, the roll displacement and the bending control at all graduated strip widths.

The adjusted strip profile shapes, strip temperatures and roll temperatures which are stored in a multidimensional data matrix are utilized for the model adjustment by forming a correction value.

In addition to roll displacement, the roll gap can be adjusted by an asymmetrical application to the lower and upper work rolls of pairs of bending forces having the same total force magnitude, wherein the bending forces of each pair are equal or different and the directions of the bending forces are in the same or opposite directions.

The method for controlling the strip planarity can be used in flexible rolling of cold or heated strip material.

While specific embodiments of the invention have been described in detail to illustrate the inventive principles, it will be understood that the invention may be embodied otherwise without departing from such principles.

We claim:

1. A method for preadjusting and controlling strip planarity in flexible single-pass and reversing rolling of a strip-shaped material web using at least one work roll pair forming a roll gap and back-up rolls for the work rolls, and devices for roll adjustment, roll bending, roll displacement and roll balancing, the method comprising, when rolling a thickness ramp for adjusting a desired strip profile shape over the strip width, determining corresponding adjustment parameters by accessing on-line a multidimensional data matrix produced off-line through a FEM model for all adjustment ranges of rolling force, roll displacement and bending control at all occurring strip widths.

2. The method according to claim 1, comprising, for reducing the data quantity of the multidimensional data matrix, determining the strip profile shapes determined off-line through a FEM model for graduated adjustment ranges of the rolling force, the roll displacement and the bending control at all graduated strip widths.

3. The method according to claim 1, comprising, when rolling a thickness ramp for adjusting a desired strip profile shape over the strip width, determining corresponding adjustment parameters on-line by means of a FEM model.

4. The method according to claim 1, comprising utilizing the adjusted strip profile shapes over the strip width for all adjustment ranges of the rolling force, the roll displacement and the bending control at all occurring strip widths and for a data and/or model adjustment by forming a correction value.

5. The method according to claim 1, comprising determining the adjusted strip profile shapes and strip temperatures over the strip width, storing the strip profile shapes and strip temperatures in a multidimensional data matrix and utilizing the strip profile shapes and strip temperatures for a data and/or model adjustment by forming a correction value.

6. The method according to claim 1, comprising determining the adjusted strip profile shapes and roll temperatures over the strip width, storing the strip profile shapes and roll temperatures in a multidimensional data matrix and utilizing the strip profile shapes and roll temperatures for a data and/or model adjustment by forming a correction value.

7. The method according to claim 1, comprising determining the adjusted strip profile shapes over the strip width, and storing the adjusted strip profile shapes for on line access to the corresponding adjustment parameters in a multidimensional data matrix for all adjustment ranges of the rolling force, the roll displacement and the bending control at all occurring strip widths.

8. The method according to claim 1, comprising utilizing for the roll gap adjustment in addition to the roll displacement an asymmetrical application of bending forces of equal total magnitudes to the lower and upper work rolls, wherein the bending forces of each pair have the same or different magnitudes, and wherein the bending forces act in the same or opposite directions.

9. The method according to claim 1, comprising utilizing the method in flexible rolling of cold or heated strip-shaped material webs.

* * * * *